US005165219A

United States Patent [19]

Sekiguchi et al.

[11] Patent Number: 5,165,219

[45] Date of Patent: Nov. 24, 1992

[54] PACKING DEVICE FOR ARTICLES THAT HAVE DIRECTIONALITY

[75] Inventors: Kazuya Sekiguchi, Ikoma; Masao Taguchi, Osaka; Hitoshi Iwata, Kyoto, all of Japan

[73] Assignee: House Food Industrial Co., Ltd., Japan

[21] Appl. No.: 799,286

[22] Filed: Nov. 27, 1991

[30] Foreign Application Priority Data

Nov. 29, 1990 [JP] Japan ..... 2-333374
Nov. 25, 1991 [JP] Japan ..... 3-309264

[51] Int. Cl.[5] ..... B65B 35/58; B65B 57/10

[52] U.S. Cl. ..... 53/493; 53/142; 53/544; 53/52

[58] Field of Search ..... 53/493, 52, 77, 143, 53/142, 145, 146, 544

[56] References Cited

U.S. PATENT DOCUMENTS 4,069,644 1/1978 Danielsen ..... 53/142 X
4,623,296 11/1986 McGuire et al. ..... 53/52 X
4,686,813 8/1987 Sawada ..... 53/544 X
4,694,637 9/1987 Bech et al. ..... 53/142 X
5,010,713 4/1991 Leander ..... 53/544 X

FOREIGN PATENT DOCUMENTS 60-28252 7/1985 Japan .
63-56246 2/1988 Japan .

*Primary Examiner*—James F. Coan
*Attorney, Agent, or Firm*—Mason, Fenwick & Lawrence

[57] ABSTRACT

A packing device for articles having directionality that includes imaging means for taking an image of the articles, means for recognizing the direction of the articles, first memory means for storing the direction of the articles, second memory means for storing the direction of the articles to be packed into a container, and means for calculating the difference in angle between the directions stored in the first and second memory means. The direction of the robot hand for grasping the articles is controlled by the output of the calculating means.

4 Claims, 5 Drawing Sheets

PACKING DEVICE FOR ARTICLES THAT HAVE DIRECTIONALITY

BACKGROUND OF THE INVENTION

1. Field of the Invention

This invention pertains to a packing device that can align oblong and other articles having directionality into their proper direction and pack them into containers.

2. Description of the Prior Art

Japanese Patent Publication No. 60-28252 and Japanese Patent Disclosure No. 63-56246 show technologies for aligning the direction of oblong articles, such as fried shrimp, fried fish, sausage, and fish paste, which recognize the head and tail. However, packing of oblong articles in containers has been performed by hand, and mechanization and automation therefor have not yet been achieved.

The purpose of this invention is to provide a packing device for articles having directionality that will align articles having directionality into the proper direction and pack them into containers.

According to the present invention, the above and other objects can be accomplished by a packing device that has the following characteristics:

I. A packing device for articles with directionality that has the following characteristics:

(a) a feeder that consecutively feeds individual articles that have directionality, (b) imaging means for taking an image of said articles, (c) recognizing means for recognizing the direction of the article by processing of the image as taken by the imaging means, (d) first memory means for storing the direction of the articles as recognized by the recognizing means, (e) a conveyor for transporting containers, (f) second memory means for storing the direction of the article which is to be packed into a container on the conveyor, (g) calculating means for calculating the difference in angle between the directions stored in the first and second memory means, (h) third memory means for storing the output of the calculating means, and (i) controlling means for controlling a robot hand for grasping the article in accordance with the difference in angle stored in the third memory means.

With the above-mentioned packing device for articles having directionality, an image is taken of the oblong articles fed consecutively by the feeder using the means for taking an image. Next the recognizing means obtains the direction of the article by processing the image of the article. This direction is stored using the first memory means. Next, the difference between the angle stored in the first memory means and the angle of the article when it is aligned for packing into containers is calculated using the means of calculation, and the result is stored using the third memory means. Next, the robot hand grasps the article, and the angle of the robot hand is controlled using the angle difference stored in the third memory means above. The above article is packed in the appropriate place in the container.

DETAILED DESCRIPTION OF THE PREFERRED EMBODIMENTS

Figure 1:
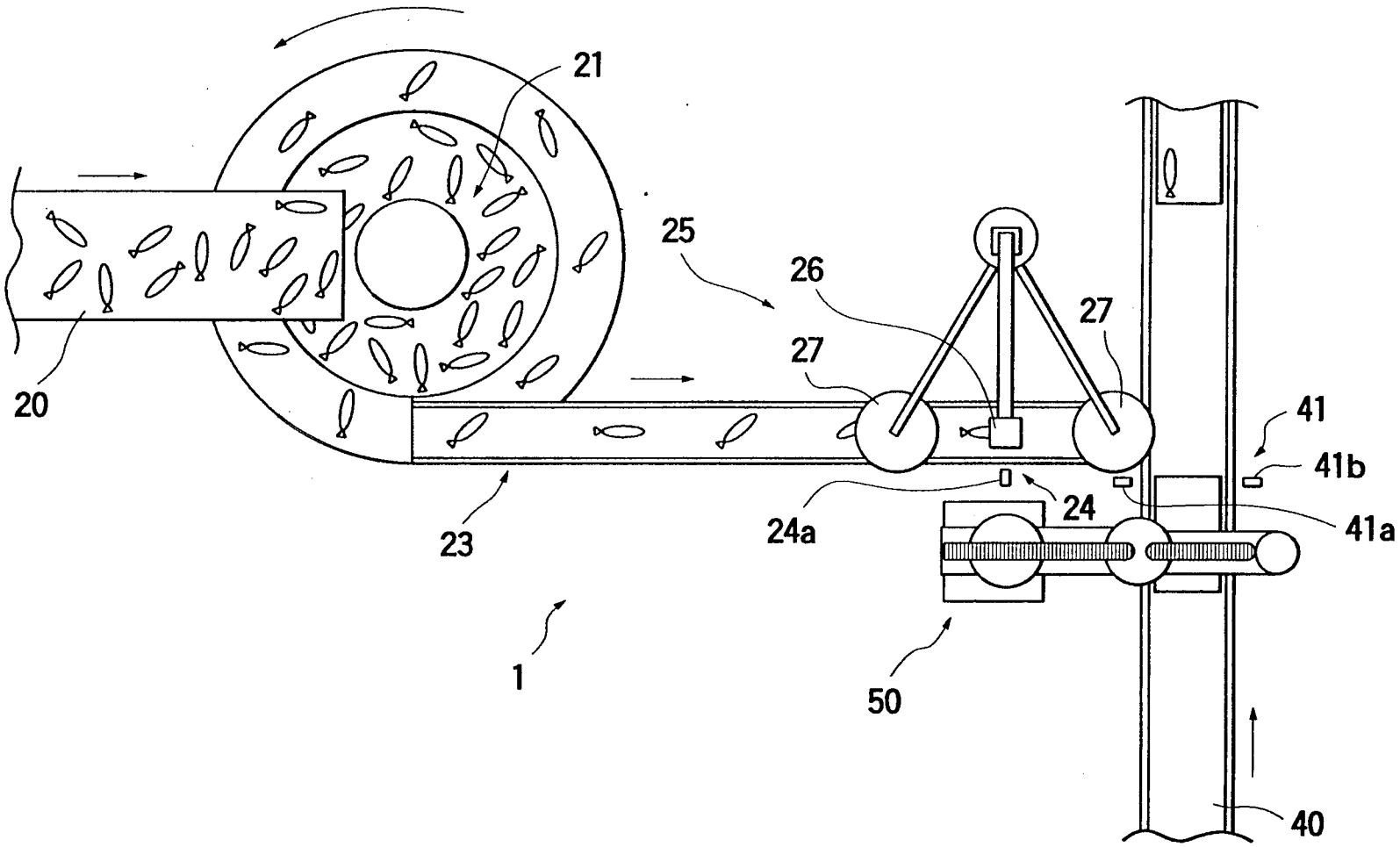
FIG. 1 is an explanation view of the packing device for oblong articles in the description of the preferred embodiment.

FIG. 1 is a simplified plan view of an embodiment of the packing device for articles having directionality in accordance with this invention. In FIG. 1, the packing device 1 has a linear feeder 20 to supply the oblong articles. A bowl feeder 21 is situated below the end in the direction of travel of the linear feeder 20 to temporarily hold the oblong articles. This allows oblong articles to be fed individually. An article transportation conveyor 23 is located at the end of the bowl feeder in the direction of travel.

A transmission optical sensor 24, comprising a light emitting element 24*a* and a light detecting element (not shown), is located midway on the above article transportation conveyor's 23 route of travel. When the oblong article arrives at the location of the transmission optical sensor 24, the article is detected by the transmission optical sensor 24, and the linear feeder 20, bowl feeder 21, and article transportation conveyor 23 are stopped.

An image processing device 25 is located above the transmission optical sensor 24. The image processing device 25 has imaging means 26—which includes a television camera—a light source 27, and a digitization circuit (now shown) to create binary image signals of the image from the imaging means 26.

Further, the above packing device 1 has means to recognize the surface area (projected image) of the oblong article from the binary image obtained from the above digitization processing; means of memory for storing the area recognized; means of memory for storing the expected maximum area of the oblong object; and means for determining whether the recognized area exceeds the expected maximum area.

Further the packing device 1 has means to recognize the longitudinal direction of the oblong article based on the binary image from the digitization processing; first memory means for storing the angle of the longitudinal direction of the oblong article recognized in the above recognition means; a second memory means for storing the longitudinal direction of the oblong article when packing the oblong article into a container on the container transportation conveyor; means of calculating the difference in angle between the longitudinal angle stored in the above first memory means and the longitudinal angle stored in the above second memory means; and third memory means for storing the difference in angle calculated by the above means of calculating the difference in angle.

Further, the above packing device 1 has means for controlling the direction of a robot hand for grasping the oblong article based on the angle difference stored in the above-mentioned third memory means as will be explained in detail below.

Further, a basket (not shown) is located below the end of the above article transportation conveyor 23 in the direction of travel to hold articles and to prevent them from being sent to the next process when more than one oblong article is sent at the same time.

Further, the above packing device 1 has a container transportation conveyor 40. The container transportation conveyor 40 is perpendicular to the article transportation conveyor 23 at its nearest point. A transmission optical sensor 41, comprising a light emitting element and 41*a* and a light detecting element 41*b*, is located at the packing position (the position where the containers stop) on the above container transportation conveyor 40. When the container reaches the transmission optical sensor 41 position, it is detected by the transmission optical sensor 41, and the above container transportation conveyor 40 is stopped.

A robot 50 for grasping and transporting the oblong article is located near the article transportation conveyor 23 and the container transportation conveyor 40. There are no restrictions on the robot 50 so long as it is able to grasp and transport the oblong article. One specific example using a suction type robot hand is given in detail below.

Figure 2:
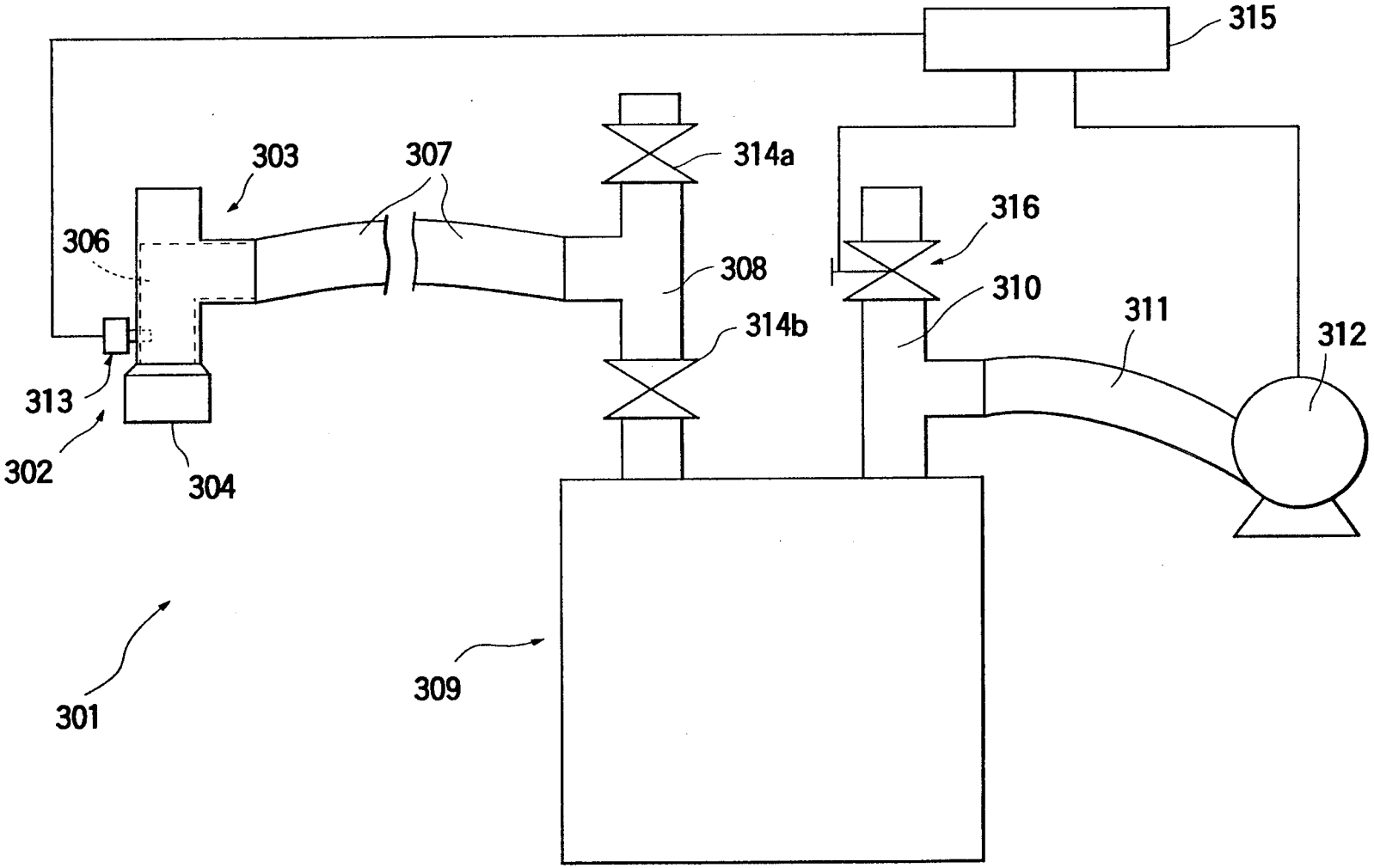
FIG. 2 is an explanation view of the robot hand.

The suction robot hand 301 as shown in FIG. 2, is attached to the end of the robot (not shown) and comprises a suction pad 302 and a robot hand 303.

Figure 3:
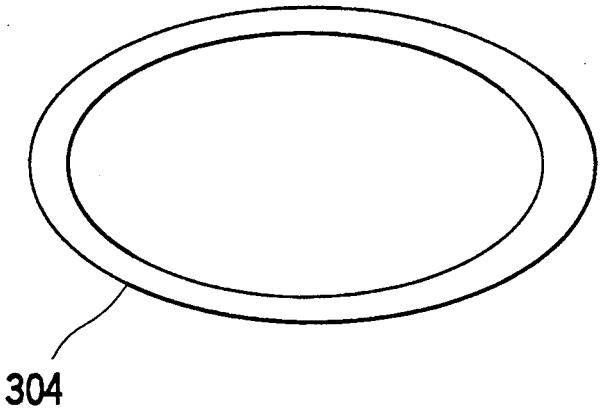
FIG. 3 is a plan view of the bottom of the suction pad.
Figure 4:
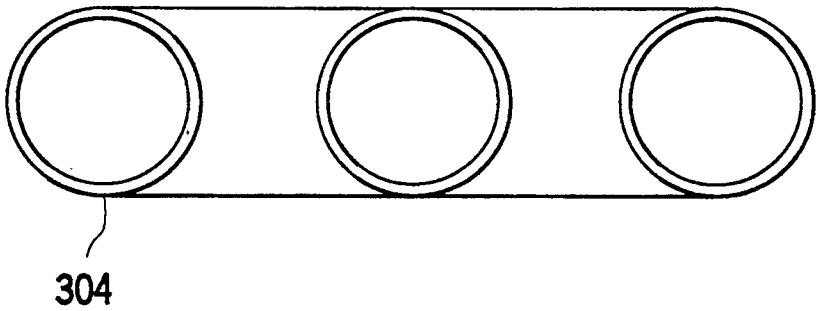
FIG. 4 is a plan view of other suction pad bottoms.

The suction pad 302 should use an elliptical, rectangular, or other oblong shape for the openings in the bottom as shown in FIG. 3 or multiple openings in parallel as shown in FIG. 4 to allow the best grasp of the oblong articles.

Figure 5:
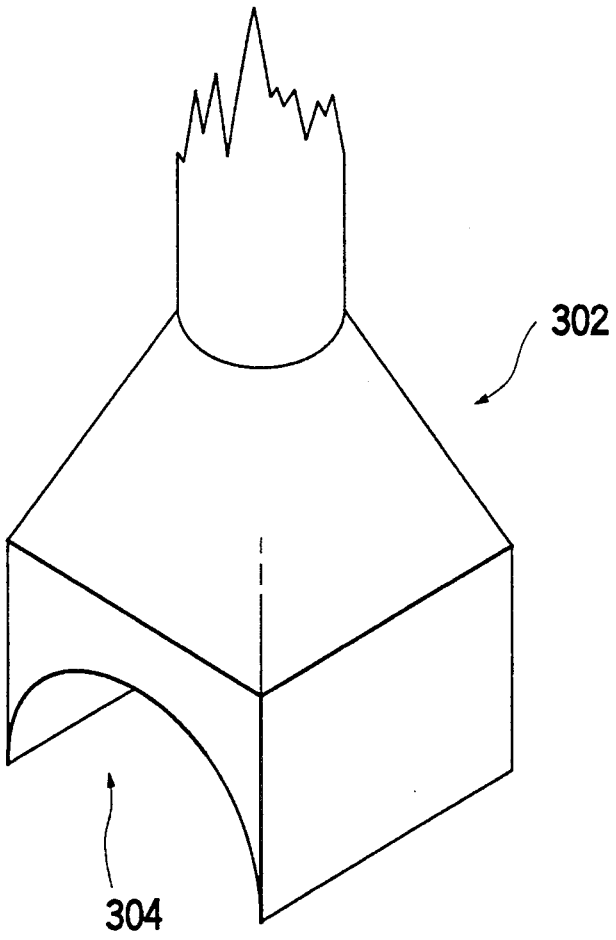
FIG. 5 is a perspective view of another suction pad.

Further, when the oblong article is rounded, such as for fried shrimp, fish paste, or sausages, a suction pad with an opening 304 as shown in FIG. 5 should be used. This will allow the edge of the opening 304 to be in almost complete contact with the top of the article during suction, preventing large volumes of air from entering the suction pad 302. As a result, rounded articles can be lifted. In this case, the shape of the opening 304 can be semi-round, semi-elliptical, etc.

Figure 6:
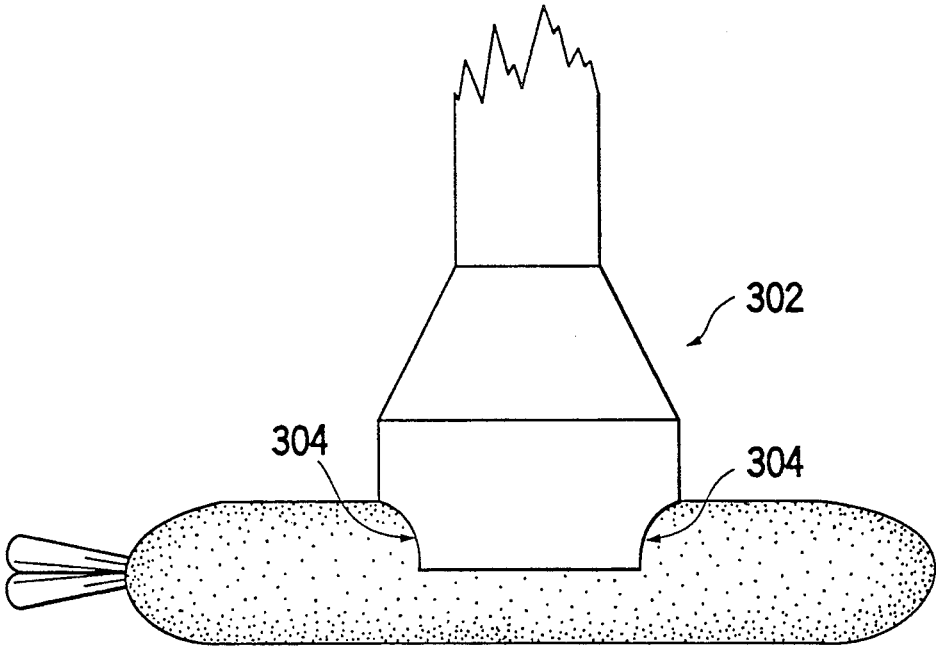
FIG. 6 is a front elevation of another suction pad.
Figure 7:
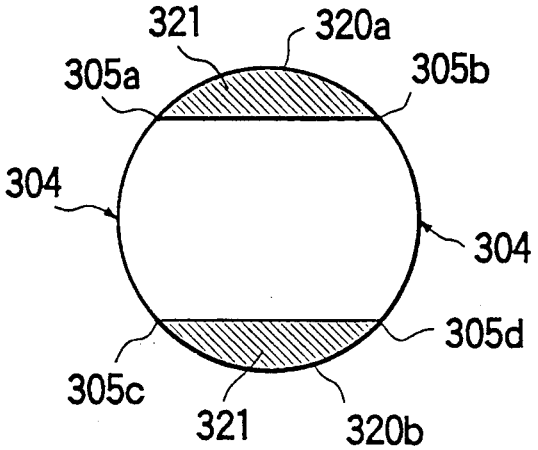
FIG. 7 is a plan view of the bottom of the suction pad in FIG. 6.

There are no particular restrictions on the shape of the above suction pad; it can be prismatic as shown in FIG. 5, cylindrical as shown in FIG. 6, cup shaped, or any other shape. Further, when the maximum width of the suction pad 302 is larger than the width of the opening 304 as shown in FIG. 6 and FIG. 7, a baffle is attached to the face described by the straight line connecting edges 305*a* and 305*b*—corresponding to both openings 304—and the bottom edge 320*a* and the face described by the straight line connecting 305*c* and 305*d* and the bottom edge 320*b*, thus more effectively preventing air from entering the suction pad 302.

Further, there are no particular restrictions on the material for suction pad 302, but flexible materials, such as rubber and synthetic resin, should be used to prevent damage during suction to food and other articles that are unwillingly damaged.

The above suction pad 302 is attached to the tip of the robot hand 303, which contains the vacuum passage 306. The vacuum passage 306 is connected to the suction pad 302.

Inside the above vacuum passage 306 and slightly above the position of the suction pad 302 is a pressure sensor 313 for detecting decreases in pressure inside the suction pad 302.

The side of the above vacuum passage 306 that is not connected to the suction pad 302 is connected to a tank 309 via the first vacuum flow pipe 307 and a first connecting pipe 308. The tank 309 is connected to a pump 312 via a second connecting pipe 310 and a second vacuum flow pipe 311.

The tank 309 accumulates water and particulate matter from the air sucked in by pump 312 in the bottom of the tank to prevent them from entering the pump 312. Further, by sufficiently reducing the pressure reduction in tank 309, suction of articles by suction pad 302 can be performed in a short period of time.

The first vacuum flow pipe 307 is flexible enough and long enough to respond to the movements of the robot. Further, the first connecting pipe 308 contains a first ball valve 314*a* and the a second ball valve 314*b*.

Further, a leak valve 316 is attached to regulate the pressure of the second connecting pipe 310. The leak valve 316 and the pump 312 are connected to the control device 315 to control the air flow based on the reduction in pressure detected by the pressure sensor 313.

Next we will explain in detail the packing device operation for the above oblong articles. First, the container transportation conveyor 40 is operated. When the container reaches the packing position, it is detected by the transmission optical sensor 41, comprising a light emitting element and 41*a* and a light detecting element 41*b*, and the above container transportation conveyor 40 is stopped.

At the same time, the oblong articles supplied by the linear feeder 20 are fed individually by the bowl feeder 21 and are supplied by the article transportation conveyor 23.

Next, the oblong article is transported by the article transportation conveyor 23. When the oblong article comes underneath the image processing device 25, the article is detected by the transmission optical sensor 24, and the linear feeder 20, bowl feeder 21, and article transportation conveyor 23 are stopped.

Next, an image of the oblong object is taken by a television camera, which is the imaging means 26. The image is sent to the digitization circuit for digitization. The surface area (projected image) of the oblong article from the binary image obtained from the above digitization processing is recognized. Next, the surface area is stored in the memory means and is compared with the expected maximum area stored in the memory means for the expected maximum area. If the result shows that the surface area recognized is larger than the expected maximum area, it is determined that multiple articles have been fed at the same time, and the robot at the next process will not grasp the article. Thus, the oblong articles will fall off the end of the article transportation conveyor into the basket placed there for that purpose. When a set volume of the articles accumulates in the basket, they are returned to the linear feeder 20. Also, a conveyor that returns to the linear feeder 20 or to the bowl feeder 21 may be used.

Next, if the surface area recognized is equal to or less than the above expected maximum area, then the longitudinal angle of the oblong article is recognized using the means to recognize the longitudinal direction angle of the oblong object from the above binary image. Means, for example, would be to find the inertial moment of the oblong article, to let the long axis be the longitudinal direction of the article, and to recognize that angle and store it in the memory means.

When the oblong article has a head and a tail, such as for fried shrimp, the head and tail ends will be recognized in addition to the longitudinal recognition. Means, for example, to recognize the head and tail ends would be to find the center of gravity from the binary image and to find the most distant point from that center, determining that the side with the most distant point is the tail side.

Next, the difference in angle between the longitudinal direction angle of the oblong article stored in the above first memory means and the longitudinal direction angle of the oblong article, which is aligned in the container at the time of packing, stored in the above second memory means is calculated. In this case, if the heads and tails are to be aligned, then the calculation of the difference in angle is performed so that the heads and tails will be in the proper direction. The difference in angle thus derived is stored in the third memory means.

At the same time, the robot 50 closes the ball valve 314*b* and operates the pump 312, regulating the tank 309 to sufficiently low pressure reduction, such as 15–300 mmHg.

Next, the robot 50 is operated, and the suction pad 302 changes the horizontal angle depending on the longitudinal direction of the oblong article. As shown in FIG. 3 and FIG. 4, when, for example, the opening on the bottom face of suction pad 302 is elliptical, rectangular, or some other oblong shape, or when multiple openings are arranged in parallel, the suction pad 302 changes the horizontal angle so that the longitudinal direction of the oblong shaped opening or the center line of the multiple openings situated in parallel is in line with the longitudinal direction of the oblong article.

Next, the tip of the suction pad 302 moves to touch the oblong article. Further, when the suction pads with openings corresponding to the lower edge as shown in FIG. 5 to FIG. 7 are used, suction pad 302 changes its direction and moves into position so that the edge of the opening 304 matches the upper surface of the article.

Next, the pump 312 is operated while turning a ball valve 314*b* to the open position. This causes the vacuum to pass from tank 309 through the first connecting pipe 308, the first vacuum flow pipe 307, and the robot hand's 303 vacuum passage 306, thus reaching the inside of the suction pad 302. This allows suction to be applied to the oblong article by the suction pad 302.

At the same time, the pressure sensor 313 detects the reduction of pressure inside the suction pad 302 and sends this value to the control device 315. Based on this value, control device 315 regulates the air suction volume by controlling leak valve 316 and the pump 312 so that the reduction in pressure satisfies the following formula.

A specific means, for example, to regulate the air suction volume would be to use a commonly known control method, such as PID control, to maintain the designated value.

(suction pad internal pressure reduction)×(pressure pad opening area)=(the force to lift the article)>(the expected maximum weight of the article)

The opening area in the above formula means the opening area in a projection view from above.

As stated above, the reduction of pressure within the suction pad 302 is detected and the air suction volume is controlled, thus allowing the reduction of pressure within the suction pad (the force used by the suction pad 302 to lift articles) to be kept at a stable value, thus allowing for example, fried products, which have uneven surfaces and where gaps between the article and the suction pad opening often occur, to be lifted with certainty.

Next, the suction pad 302 while holding the article with its suction changes its direction based on the difference in angle stored in the third memory means.

Next, the robot is operated, and the article is moved to the correct location in the container.

Next, the ball valve 314*b* is closed, and the ball valve 314*a* is opened. This causes atmospheric pressure to pass through the first connecting pipe 308, the first vacuum flow pipe 307, and the robot hand's 303 vacuum passage 306, thus reaching the inside of the suction pad 302. This releases the force to lift the oblong article, and the oblong article is released from the suction pad 302, allowing the oblong article to be packed in the container in the designated direction. In this case, by attaching a pressurized air source to the ball valve 314*a*, the article can be released from the suction pad 302 in a shorter period of time.

In another embodiment of the present invention, a variable-density image processing circuit is used instead of the above-mentioned binary processing circuit 25 so as to create variable-density image signals of the image from the output of the imaging means 26.

In a further embodiment of the present invention, a color image processing circuit is used instead of the above-mentioned binary processing circuit 25. The color image processing circuit recognizes the longitudinal direction of the oblong article by processing a R-component, G-component, and B-component of the color image from the output of the imaging means 26.

Whereas the drawing and accompanying description have shown and described the preferred embodiment of the present invention, it should be apparent to those in the art that various changes may be made in the form of the invention without affecting the scope thereof.

We claim:

1. A packing device for articles with directionality that has the following characteristics:

(a) a feeder that consecutively feeds individual articles that have directionality, (b) imaging means for taking an image of said articles, (c) recognizing means for recognizing the direction of the article by processing of the image as taken by the imaging means, (d) first memory means for storing the direction of the articles as recognized by the recognizing means, (e) a conveyor for transporting containers, (f) second memory means for storing the direction of the article which is to be packed into a container on the conveyor, (g) calculating means for calculating the difference in angle between the directions stored in the first and second memory means, (h) third memory means for storing the output of the calculating means, and (i) controlling means for controlling a robot hand for grasping the article in accordance with the difference in angle stored in the third memory means.

2. A packing device for articles with directionality as defined in claim 1 in which the recognizing means includes a binary processing circuit to produce binary image signals from the output of the imaging means.

3. A packing device for articles with directionality as defined in claim 1 in which the recognizing means includes a variable-density image processing circuit to produce variable-density image signals from the output of the imaging means.

4. A packing device for articles with directionality as defined in claim 1 in which the recognizing means includes a color image processing circuit to produce R-component, G-component, and B-component signals of the color image from the output of the imaging means.

* * * * *